US007626108B1

(12) United States Patent
Takegawa

(10) Patent No.: US 7,626,108 B1
(45) Date of Patent: Dec. 1, 2009

(54) BEATER WITH ANTI-VIBRATION ELEMENT

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 12/329,675

(22) Filed: Dec. 8, 2008

(51) Int. Cl.
*G10D 13/02* (2006.01)

(52) U.S. Cl. ..... 84/422.1

(58) Field of Classification Search ..... 84/422.1, 84/22.2, 422.3, 421
See application file for complete search history.

(56) References Cited

U.S. PATENT DOCUMENTS

| | | | | |
|---|---|---|---|---|
| 1,343,164 | A | 6/1920 | Smith | |
| 1,484,096 | A | 2/1924 | Van Horn | |
| 1,739,275 | A | 12/1929 | Zipperstein | |
| 2,473,865 | A | 6/1949 | Dane | |
| 2,586,163 | A | 2/1952 | Heiderich et al. | |
| 3,316,792 | A | 5/1967 | Ippolito | |
| 3,998,123 | A | 12/1976 | Hinger | |
| 4,023,461 | A | 5/1977 | Brandolino | |
| 4,307,647 | A * | 12/1981 | Christian | 84/404 |
| 4,632,006 | A | 12/1986 | Ambroszewski | |
| 4,649,792 | A | 3/1987 | Swartzlander | |
| 5,317,946 | A * | 6/1994 | Hoshino | 84/422.1 |
| 5,503,056 | A | 4/1996 | Evans | |
| 5,763,798 | A | 6/1998 | Chen | |
| 5,929,356 | A | 7/1999 | Piland et al. | |
| 6,180,860 | B1 | 1/2001 | Chen | |
| 6,307,138 | B1 | 10/2001 | Simpson | |
| 6,759,583 | B2 | 7/2004 | Mizuno et al. | |
| 6,822,149 | B1 | 11/2004 | Liao | |
| 6,875,912 | B2 | 4/2005 | Gatzen | |
| 7,427,706 | B1 | 9/2008 | Wilhelm | |
| 2008/0168890 | A1 | 7/2008 | Judd | |

* cited by examiner

*Primary Examiner*—Kimberly R Lockett
(74) *Attorney, Agent, or Firm*—Berenato & White, LLC

(57) ABSTRACT

A drum beater comprises an elongated rod adapted to be mounted to a foot-operated beater drive mechanism and a beater head main body mounted to an end of the elongated rod. The beater head main body includes a recessed area disposed at an entry area where the elongated rod passes into the beater head main body and a shock absorber member is disposed in the recessed area such that the elongated rod directly engages both the beater head main body and the shock absorber to attenuate the transfer of vibration between the beater head main body and the elongated rod. In the preferred embodiment, the recessed area is formed as an annular opening facing away from said main body and the shock absorber member is removable disposed in the recessed area.

18 Claims, 4 Drawing Sheets

BEATER WITH ANTI-VIBRATION ELEMENT

BACKGROUND OF THE INVENTION

1. Field of the Invention

The present invention relates to bass drum beaters, and more particularly to such a bass drum beater head designed to decrease energy loss when the beater strikes the drum head.

2. Description of Related Art

As shown in FIG. 1, a conventional bass drum is generally equipped with a pedal mechanism and a beater driven by the pedal mechanism to beat the face of the drum. The pedal mechanism is generally comprised of two upright supports, a transverse shaft connected between the upright supports, a cam mounted on the transverse shaft, a pedal pivoted to the cam, and a return spring coupled to one end of the transverse shaft. The beater is fastened to the cam of the pedal mechanism.

FIGS. 2 and 3 show the structure of a conventional drum beater having a cylindrical body 30 enclosed externally with a surface layer 34 made from a rubber material or a plastic material. A rod 31 is connected to the body 30 and the body 30 is positioned in between a top and a bottom positioning plates 32. A screw nut 33 is used to fasten the body 30 onto the rod 31.

The prior art however lacks the necessary structure to decrease energy loss at the beater member when it strikes the drum head without losing power, and lacks the versatility to permit the user to add or remove an anti-vibration member in a quick and easy manner.

SUMMARY OF THE INVENTION

A drum beater comprises an elongated rod adapted to be mounted to a foot-operated beater drive mechanism and a beater head main body mounted to an end of the elongated rod. The beater head main body includes a recessed area disposed at an entry area where the elongated rod passes into the beater head main body and a shock absorber member is disposed in the recessed area such that the elongated rod directly engages both the beater head main body and the shock absorber to attenuate the transfer of vibration between the beater head main body and the elongated rod. In the preferred embodiment, the recessed area is formed as an annular opening facing away from said main body and the shock absorber member is removable disposed in the recessed area.

The recessed area and the shock absorber member are annular in shape and circumscribe the elongated rod.

DETAILED DESCRIPTION OF THE PREFERRED EMBODIMENT

Figure 1:
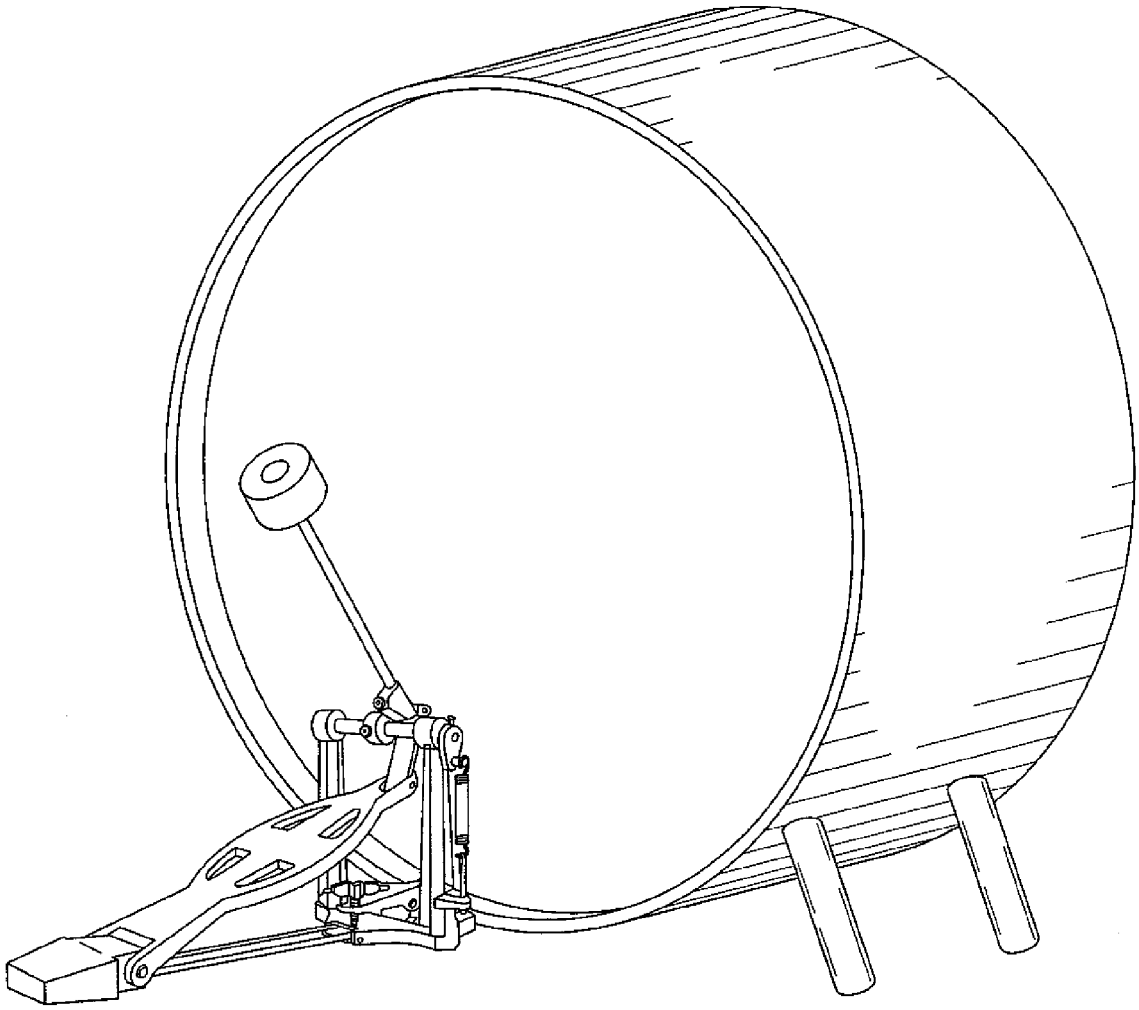
Fig. 1 Prior Art
FIG. 1 illustrates a conventional bass drum that is generally equipped with a pedal mechanism and a beater driven by the pedal mechanism to beat the face of the drum.
Figure 2:
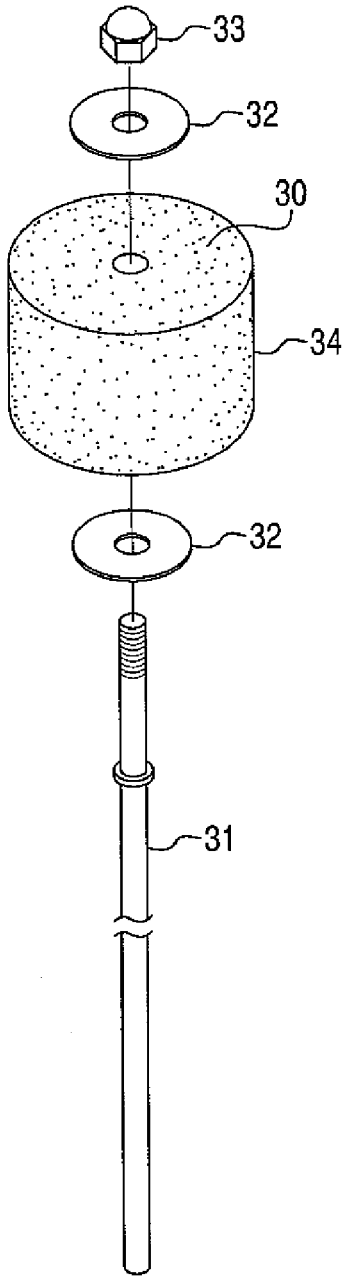
Fig. 2 Prior Art
FIGS. 2 and 3 illustrate the structure of a conventional drum beater.
Figure 3:
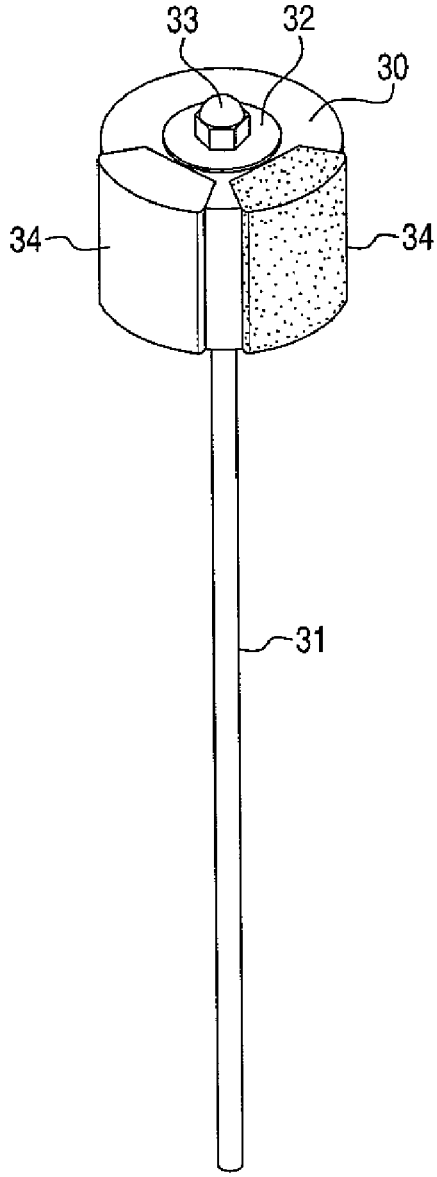
Fig. 3 Prior Art

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
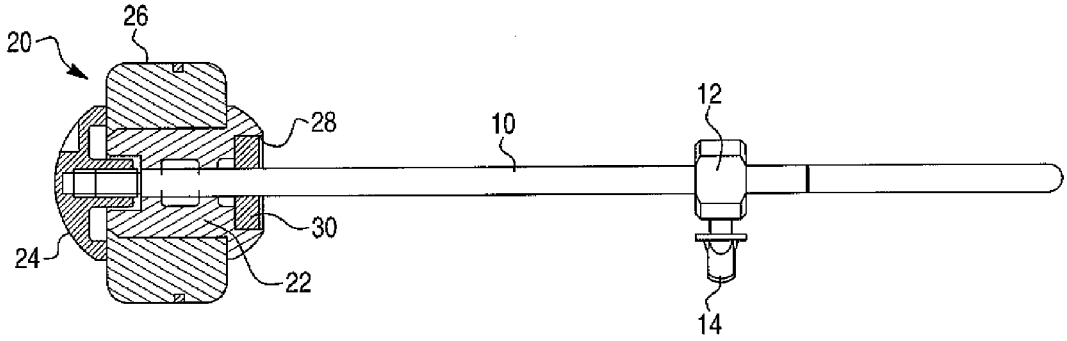
FIG. 4 illustrates a cross sectional view of the elongated rod and beater head according to the present invention.

Referring to FIG. 4, there is shown an improved structure of a drum beater comprising an elongated rod 10 and a beater head 20. The beater head includes a beater head main body 22 and a shock absorber member 30. A cap member 24 is threaded or otherwise affixed to the end of the elongated rod 10. The elongated rod 10 is constructed of steel, plastic or fiberglass. However, it is understood that the elongated rod 10 may be constructed from any rigid, yet flexible, material.

In the preferred embodiment, the elongated rod is provided with a beater stopper 12 that is adjusted along the length of the elongated rod 10 via a bolt 14 to determine the position of the rod 10 with respect to the mounting member on a foot-operated pedal assembly as shown in FIG. 1.

Figure 5:
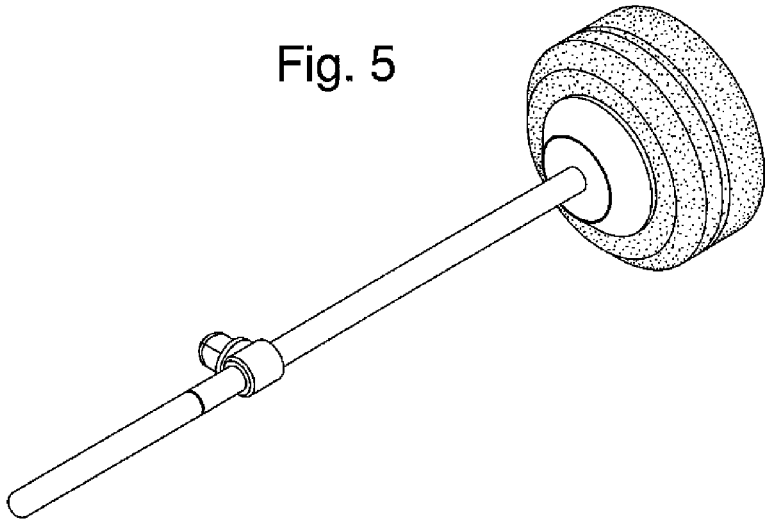
FIG. 5 illustrates a first preferred embodiment of the beater head with a felt material disposed on the outer peripheral surface of the beater head main body.
Figure 6:
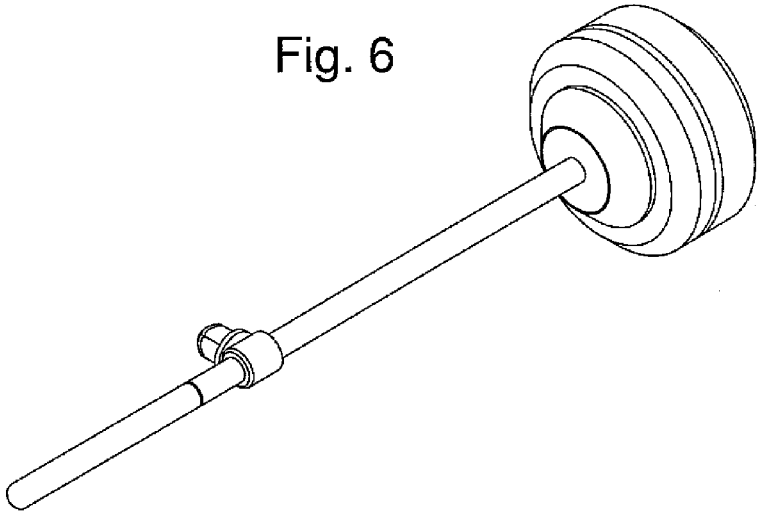
FIG. 6 illustrates a second embodiment of the beater head made of wood, rubber, plastic etc. according to this invention.

In the embodiment of FIG. 5, the beater head 20 is provided with a felt outer covering disposed on the substantially rigid body to add further resilience to soften the sound produced when the beater head strikes the drum face. While felt is the preferred material for the outer cover, the invention is intended to encompass any suitable covering material known to those of skill in the art. FIG. 5 illustrates the preferred embodiment. In the embodiment of FIG. 6, the beater head 20 is formed as a substantially rigid body formed of wood, rubber, plastic or other materials known to those of skill in the art.

Figure 7:
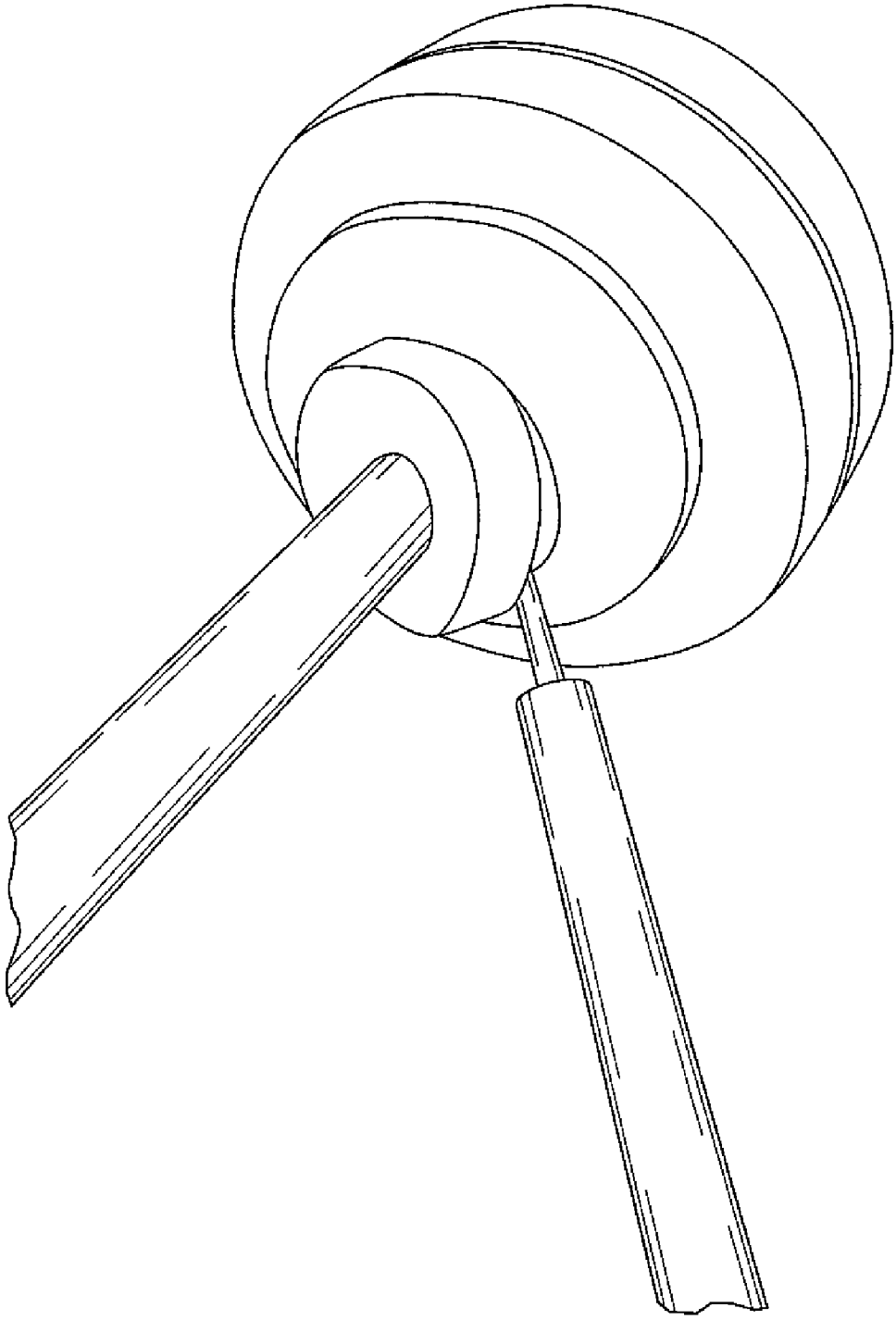
FIG. 7 illustrates the procedure for removing the shock absorber member from the recessed area of the beater head main body.

In the preferred embodiment, the shock absorber member 30 is permanently affixed to the beater assembly by glue or other fastening means. However, the shock absorber member 30 may alternately be removably disposed on the beater assembly. FIG. 7 illustrates a procedure used to remove the shock absorber member 30 from the recessed area 28 formed in the beater head main body. It is envisioned that the shock absorber 30 may be removably disposed in the recessed area 28 formed in the main body 20, such that removal of the shock absorber 30 may be accomplished through use of a tool. Likewise, the shock absorber member 30 may include a tab or other suitable means to facilitate removal from the recessed area 28.

As shown in FIG. 4, both the beater head main body 22 and the shock absorber 30 directly engage the elongated rod 10 to attenuate the transfer of vibration between said beater head main body 22 and said elongated rod 10. From the forgoing description and associated drawings, it is apparent that the invention provides the necessary structure to decrease energy loss at the beater member when it strikes the drum head for more power, and includes the versatility to permit the user to add or remove an anti-vibration member in a quick and easy manner.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

The invention claimed is:

1. A drum beater comprising:

an elongated rod adapted to be mounted to a foot-operated beater drive mechanism;

a beater head main body mounted to an end of said elongated rod, said beater head main body including a recessed area disposed at an entry area where said elongated rod passes into said beater head main body; and a shock absorber member disposed in said recessed area, wherein said recessed area is formed as an annular opening facing away from said main body, whereby said recessed area defines an intersection between said elongated rod and said main body.

2. The drum beater according to claim 1, wherein said recessed area and said shock absorber member circumscribe said elongated rod.

3. The drum beater according to claim 1, wherein said elongated rod directly engages both said beater head main body and said shock absorber to attenuate the transfer of vibration between said beater head main body and said elongated rod.

4. The drum beater according to claim 1, wherein said shock absorber member is annular in shape.

5. A drum beater, comprising:

an elongated rod adapted to be mounted to a foot-operated beater drive mechanism;

a beater head main body mounted to an end of said elongated rod, said beater head main body including a recessed area disposed at an entry area where said elongated rod passes into said beater head main body; and a shock absorber member disposed in said recessed area, wherein said shock absorber member is disposed between said main body and said elongated rod to absorb a force imparted to said main body.

6. A drum beater, comprising:

an elongated rod adapted to be mounted to a foot-operated beater drive mechanism;

a beater head main body mounted to an end of said elongated rod, said beater head main body including a recessed area disposed at an entry area where said elongated rod passes into said beater head main body; and a shock absorber member disposed in said recessed area, wherein said shock absorber member is removably disposed in said recessed area.

7. The drum beater according to claim 1, wherein said main body is round.

8. The drum beater according to claim 1, wherein said main body is cylindrical.

9. The drum beater according to claim 1, further comprising a resilient beater surface disposed on the outer peripheral surface of said beater head main body, said resilient beater surface being more resilient than said main body.

10. The drum beater according to claim 9, wherein said resilient beater surface is formed of a felt material.

11. A drum beater, comprising:

an elongated rod adapted to be mounted to a foot-operated beater drive mechanism;

a beater head main body mounted to an end of said elongated rod, said beater head main body including a recessed area disposed at an entry area where said elongated rod passes into said beater head main body;

a shock absorber member disposed in said recessed area; and a cap member fixed to an end of said elongate rod to retain said beater head main body on said elongated rod.

12. The drum beater according to claim 1, wherein said beater head main body directly engages said elongated rod at least one point along said rod adjacent said shock absorber member.

13. A drum beater comprising:

an elongated rod adapted to be mounted to a foot-operated beater drive mechanism;

a beater head main body mounted to an end of said elongated rod, said beater head main body including a recessed area;

a shock absorber member disposed in said recessed area, wherein said elongated rod directly engages both said beater head main body and said shock absorber to attenuate the transfer of vibration between said beater head main body and said elongated rod, and wherein said recessed area is formed as an annular opening facing away from said main body, whereby said recessed area defines an intersection between said elongated rod and said main body.

14. The drum beater according to claim 13, wherein said recessed area and said shock absorber member circumscribe said elongated rod.

15. The drum beater according to claim 13, further comprising a resilient beater surface disposed on the outer peripheral surface of said beater head main body, said resilient beater surface being more resilient than said main body.

16. The drum beater according to claim 13, wherein said shock absorber member is annular in shape.

17. The drum beater according to claim 13, wherein said shock absorber member is removably disposed in said recessed area.

18. The dram beater according to claim 13, further comprising a cap member fixed to an end of said elongate rod to retain said beater head main body on said elongated rod.

* * * * *